United States Patent [19]

Jennings

[11] Patent Number: 4,903,686

[45] Date of Patent: Feb. 27, 1990

[54] OUTER HEARTH PAD

[76] Inventor: Thad Jennings, 11300 Cimarron Rd., Oklahoma City, Okla. 73162

[21] Appl. No.: 269,474

[22] Filed: Nov. 9, 1988

[51] Int. Cl.[4] ..... F24B 13/02

[52] U.S. Cl. ..... 126/500; 5/242; 248/345.1

[58] Field of Search ..... 126/500; 52/3, 515, 52/DIG. 13; 5/100, 512, 493, 424; 428/74, 99, 100; 248/345, 345.1

[56] References Cited

U.S. PATENT DOCUMENTS

| | | | |
|---|---|---|---|
| 2,293,751 | 8/1942 | May . | |
| 2,518,107 | 8/1950 | Wilson | 228/60 |
| 2,606,755 | 8/1952 | Samuels | 267/1 |
| 2,867,015 | 1/1959 | Meissner . | |
| 3,712,003 | 1/1973 | Hallock et al. | 52/254 |
| 4,117,782 | 10/1978 | Cahill | 108/27 |
| 4,153,230 | 5/1979 | Giacin | 248/345.1 |
| 4,787,366 | 11/1988 | Bell | 126/500 |

*Primary Examiner*—Larry Jones

*Attorney, Agent, or Firm*—Dunlap, Codding, Peterson & Lee

[57] ABSTRACT

An outer hearth pad is provided with a frame for overlying the elevated peripheral edges of an outer hearth. A padding material is secured to the outer surface of the frame by a covering material overlying the padding material, the covering material being secured to the inner surface of the frame. The outer hearth pad is secured to the outer hearth by portions of the outer hearth pad engaging portions of the outer hearth.

14 Claims, 3 Drawing Sheets

OUTER HEARTH PAD

FIELD OF THE INVENTION

The present invention relates generally to an outer hearth pad for covering a portion of the outer hearth. The present invention also relates generally to methods for making outer hearth pads.

DESCRIPTION OF THE PREFERRED EMBODIMENTS

Generally, elevated outer hearths are constructed of materials such as stone, brick, rock, ceramic tile and the like. In certain instances, a hearth constructed of these materials is found to include one or more acute protruding edges. Hearths of this design, while presenting an attractive and decorative appearance, also present an insidious threat of injury to persons falling against or otherwise forcefully contacting one of the outer hearth edges.

The present invention not only reduces the chance of serious injury to persons contacting an outer hearth edge, but may also provide a comfortable surface to lean or sit upon. The present invention may also be provided with a complementing, decorative covering which may be aesthetically enhancing in some applications.

Figure 1:
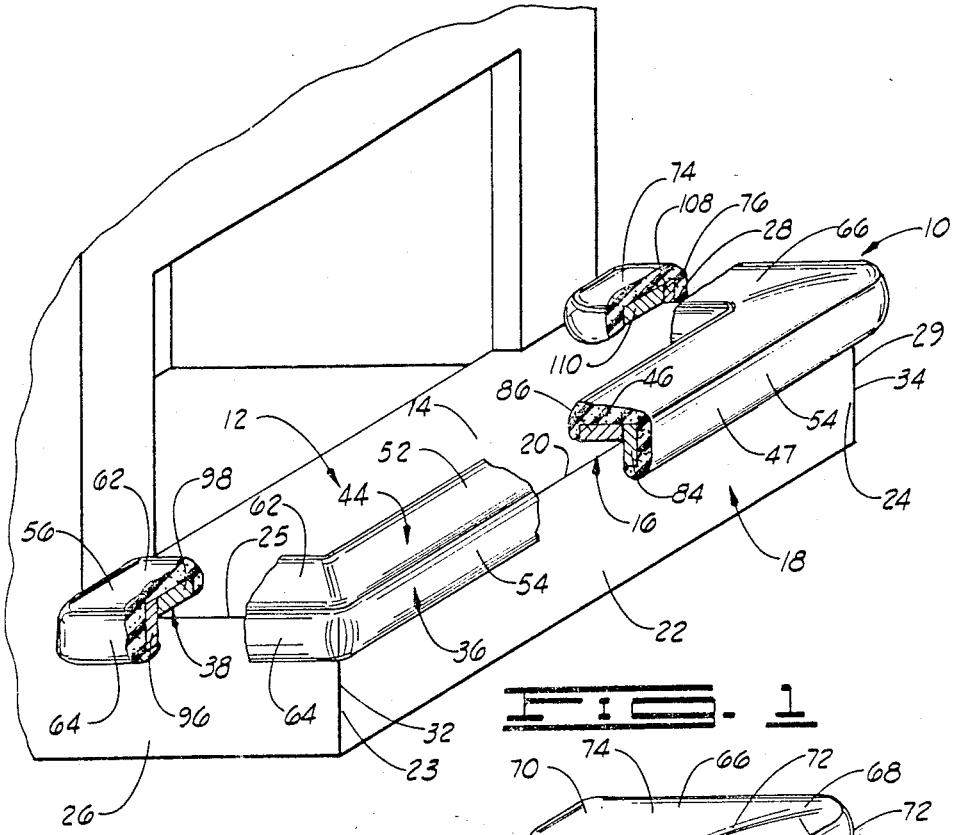
FIG. 1 is a perspective view of the outer hearth pad secured to an outer hearth and constructed in accordance with the present invention.

As shown in FIG. 1, and described herein by the general reference numeral 10, is an outer hearth pad constructed in accordance with the present invention and secured to an outer hearth 12. The outer hearth 12 comprises an elevated top surface 14 extending generally in a horizontal plane and a horizontally extending elevated edge 16 formed by the intersection of a side surface 18 and the top surface 14. The elevated edge 16 comprises a front elevated edge 20 formed by the intersection of a front side surface 22 having opposite ends 23 and 24 and the elevated top surface 14. The elevated edge 16 also comprises a first end elevated edge 25 formed by the intersection of a first end side surface 26 with the elevated top surface 14. The elevated edge 16 further comprises a second end elevated edge 28 formed by the intersection of a second end side surface 29 with the elevated top surface 14.

A first vertical edge 32 is formed by the intersection of the first end side surface 26 with end 23 of the front side surface 22. First vertical edge 32 extends upwardly and intersects the elevated edge 16 forming a first elevated corner (not shown) of the outer hearth. A second vertical edge 34 is formed by the intersection of the second end side surface 29 with end 24 of the front side surface 22. The second vertical edge 34 extends upwardly and intersects the elevated edge 16 forming a second elevated corner (not shown) of the outer hearth 12.

Figure 2:
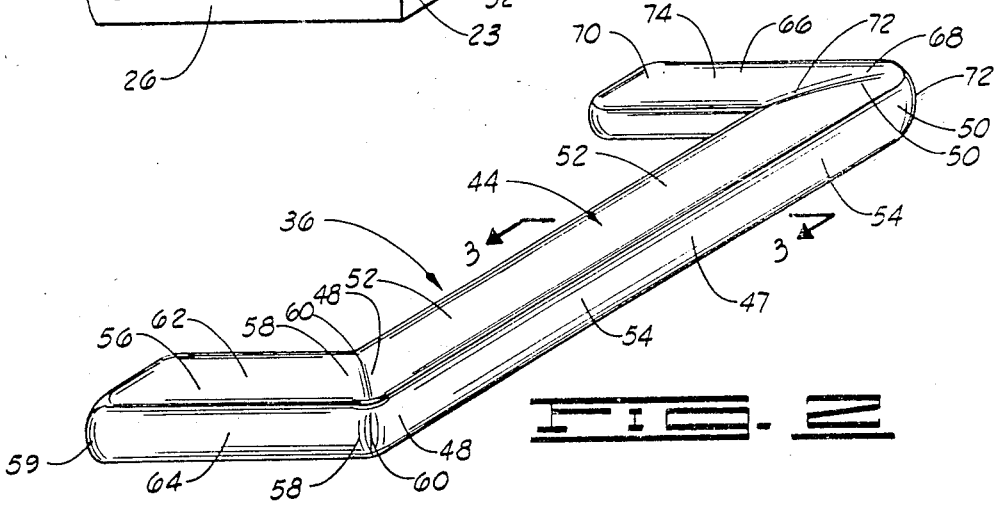
FIG. 2 is a perspective view of the outer hearth pad shown in FIG. 1.
Figure 3:
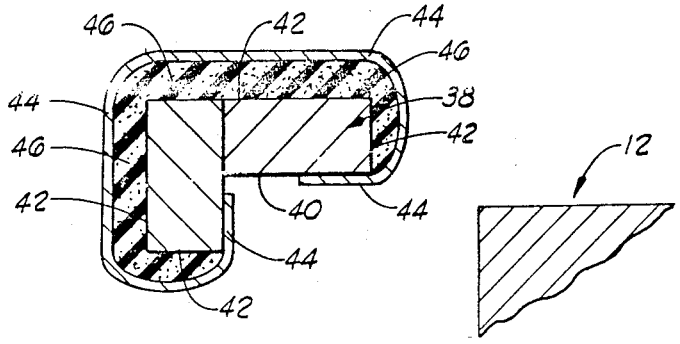
FIG. 3 is a cross-sectional view of the outer hearth pad taken substantially along lines 3-3 of FIG. 2.
Figure 4:
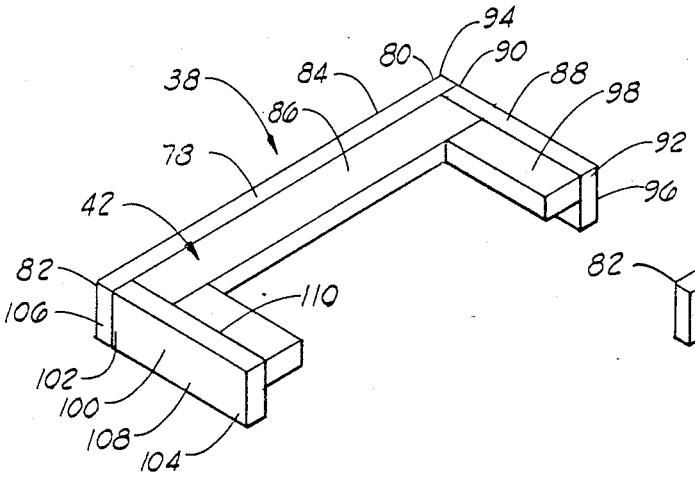
FIG. 4 is a perspective view of the frame assembly of the outer hearth pad.

Referring now to FIGS. 2, 3 and 4, the outer hearth pad 10 comprises a cover assembly 36 and a frame assembly 38. As shown most clearly in FIG. 3, the frame assembly 38 comprises an inner surface 40 and an outer surface 42. The cover assembly 36 comprises a covering material 44, preferably constructed of a flame retardant material, and a resilient padding material 46. The padding material 46 substantially overlies the outer surface 42 and is secured to the frame assembly 38 by the covering material 44. The covering material 44 is secured, as by stapling or tacking, to the inner surface 40 of the frame assembly 38. In this way, the padding material 46 is sandwiched between the covering material 44 and the outer surface 42 of the frame assembly 38. Thus, a portion of the covering material 44 overlying the inner surface 40 of the frame assembly 38 contacts the outer hearth 12 near the elevated edge 16 when the hearth pad 10 is secured to the outer hearth 12.

Referring again to FIG. 2, the cover assembly 36 further comprises a front cover assembly 47 having ends 48 and 50. The front cover assembly further comprises a front top portion 52 and a front side portion 54. The orientation of the front top portion 52 and the front side portion 54 to the frame assembly 38 is described in detail below.

The cover assembly 36 further comprises a first side cover assembly 56 having ends 58 and 59. The intersection of end 48 of the front cover assembly 47 with end 58 of the first side cover assembly 56 forms a first cover assembly corner 60 of the cover assembly 36. The first side cover assembly 56 further comprises a first side top portion 62 and a first side portion 64. The orientation of the first cover assembly corner 60, the first side top portion 62 and the first side portion 64 to the frame assembly 38 is described in detail below.

The cover assembly 36 also comprises a second side cover assembly 66 having ends 68 and 70. The intersection of end 50 of the front cover assembly 47 with the end 68 of the second side cover assembly 66 forms a second cover assembly corner 72 of the cover assembly 36. The second side cover assembly 66 further comprises a second side top portion 74 and a second side portion 76 (FIG. 1). The orientation of the second cover assembly corner 72, the second side top portion 74 and the second side portion 76 to the frame assembly 38 is described in detail below.

Figure 5:
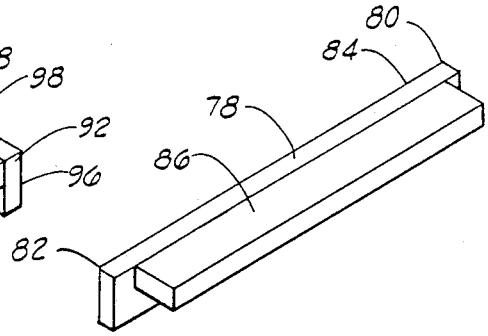
FIG. 5 is a perspective view of the front assembly of the frame assembly of the outer hearth pad shown in FIG. 4.

Turning now to FIGS. 4 and 5, the frame assembly 38 includes a front assembly 78 having ends 80 and 82. The front assembly 78 comprises a front side panel 84 and a front top panel 86. It will now be appreciated that the front top portion 52 of the cover assembly 36 overlies the front top panel 86 of the frame assembly 38 and the front side portion 58 of the cover assembly 36 overlies the front side panel 84 of the frame assembly 38. In this way, as shown generally in FIG. 1, when the hearth pad 10 is secured to the outer hearth 12, the front side panel 84, in combination with the front side portion 54, generally extends a distance over the front side surface 22 near the front elevated edge 20, and the front top panel 86, in combination with the front top portion 52, generally extends a distance over the top surface 14 near the front elevated edge 20.

As shown in FIG. 4, the frame assembly 38 further comprises a first side assembly 88 having ends 90 and 92. The end 90 of the first side assembly 88 is preferably secured to end 80 of the front assembly 78 forming a first frame assembly corner 94. The first side assembly 88 also comprises a first side panel 96 and a first side top panel 98. It will now be appreciated that the first cover assembly corner 60 overlies the first frame assembly corner 94, the first side top portion 62 of the cover assembly 36 overlies the first side top panel 98 of the frame assembly 38, and the first side portion 64 of the cover assembly 36 overlies the first side panel 96 of the frame assembly 38. In this way, as shown generally in FIG. 1, when the hearth pad 10 is secured to the outer hearth 12, the first frame assembly corner 94, in combination with the first cover assembly corner 60 overlies the first elevated corner of the outer hearth 12, the first side panel 96, in combination with the first side portion 64, generally extends a distance over the first end side surface 26 near the first end elevated edge 25, and the first side top panel 98, in combination with the first side top portion 62, generally extends a distance over the top surface 14 near the first end elevated edge 22.

Figure 6:
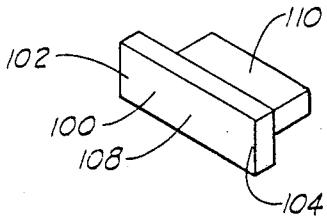
FIG. 6 is a perspective view of the side assembly of the frame assembly of the outer hearth pad shown in FIG. 4.

As shown in FIGS. 4 and 6, the frame assembly 38 also includes a second side assembly 100 having ends 102 and 104. The end 102 of the second side assembly 100 is preferably secured to end 82 of the front assembly 78 forming a second frame assembly corner 106. The second side assembly 100 further comprises a second side panel 108 and a second side top panel 110. It will now be appreciated that the second side top portion 74 of the cover assembly 36 overlies the second side top panel 110 of the frame assembly 38 and the second side portion 76 of the cover assembly 36 overlies the second side panel 108 of the frame assembly 38. In this way, as shown generally in FIG. 1, when the hearth pad 10 is secured to the outer hearth 12, the second frame assembly corner 106, in combination with the second cover assembly corner 72, overlies the second elevated corner of the outer hearth 12, the second side panel 108, in combination with the second side portion 76, generally extends a distance over the second end side surface near the second end elevated edge 28, and the second side top panel 110, in combination with the second side top portion 74, generally extends a distance over the top surface 14 near the second end elevated edge 28.

As shown in FIGS. 4 through 6, ends 80 and 82 of the front assembly 78 are cooperatively notched for attachment with ends 90 and 102 of the first side assembly 88 and the second side assembly 100, respectively.

When the frame assembly 38 with the cover assembly 36 connected thereto is fitted onto the elevated edge 16 of the outer hearth 12, the frame assembly 38 with the cover assembly 36 connected thereto is disposed over the elevated edge 16 and the cover assembly 36 protectively covers a portion of the elevated edge 16 over which it extends when the frame assembly 38 with the cover assembly 36 connected thereto is disposed over the elevated edge 16. More particularly, a portion of the cover assembly 36 extends over a portion of the front side surface 22 generally near the front elevated edge 20, a portion of the frame assembly 38 with the cover assembly 36 connected thereto extends over a portion of the top surface 14 generally near the front elevated edge 20, a portion of the frame assembly 38 with the cover assembly 36 connected thereto extends over a portion of the first end side surface 26 generally near the first end elevated edge 25 and another portion of the frame assembly 38 with the cover assembly 36 connected thereto extends over a portion of the top surface 14 generally near the first end elevated edge 25, and a portion of the frame assembly 38 with the cover assembly 36 connected thereto extends over a portion of the second end side surface 29 generally near the second end elevated edge 28 and another portion of the frame assembly 38 with the cover assembly 36 connected thereto extends over a portion of the top surface 14 generally near the second end elevated edge 28.

Figure 7:
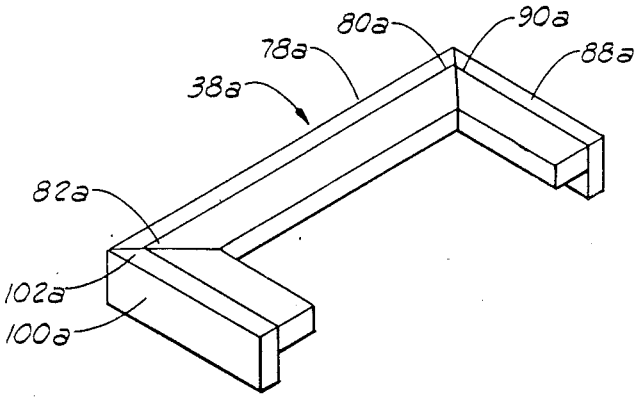
FIG. 7 is a perspective view of a modified frame assembly.
Figure 8:
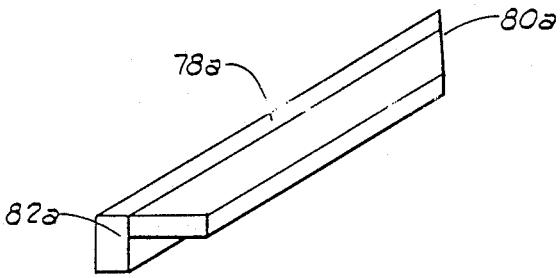
FIG. 8 is a perspective view of a modified front assembly of the modified frame assembly shown in FIG. 7.
Figure 9:
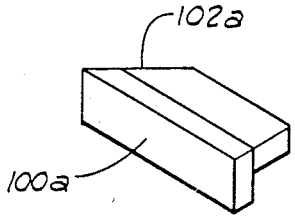
FIG. 9 is a perspective view of a modified side assembly of the modified frame assembly shown in FIG. 7.

A modified frame assembly **38*a*, having a front assembly 78*a*, a first side assembly 88*a* and a second side assembly 100*a*, is shown in FIGS. 7 through 9. The frame assembly 38*a* is constructed exactly like the frame assembly 38, described in detail before, except the frame assembly 38*a* includes beveled ends 80*a* and 82*a* of the front assembly 78*a* and beveled ends 90*a* and 102*a* of the first side assembly 88*a* and the second side assembly 100*a*, respectively. In this way, the beveled ends of the front assembly 78*a* are cooperatively mitered for respective attachment to the corresponding beveled ends of the first side assembly 88*a* and the second side assembly 100*a***.

Figure 10:
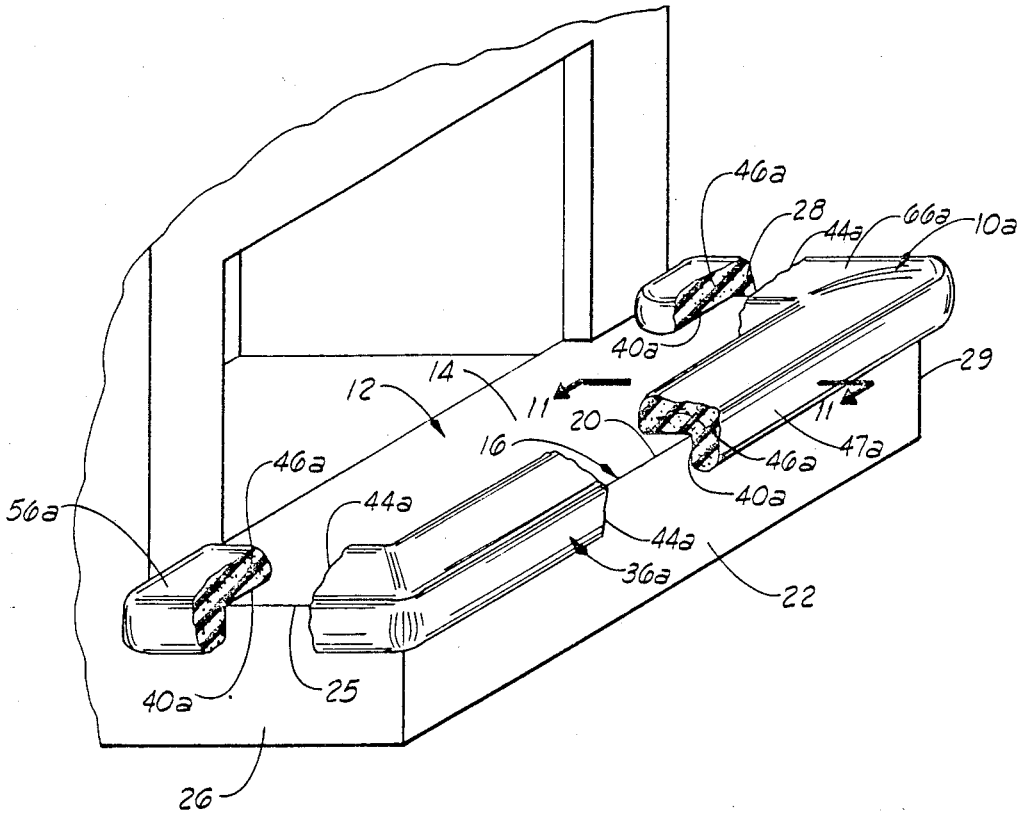
FIG. 10 is a perspective view of a modified outer hearth pad secured to the outer hearth.
Figure 11:
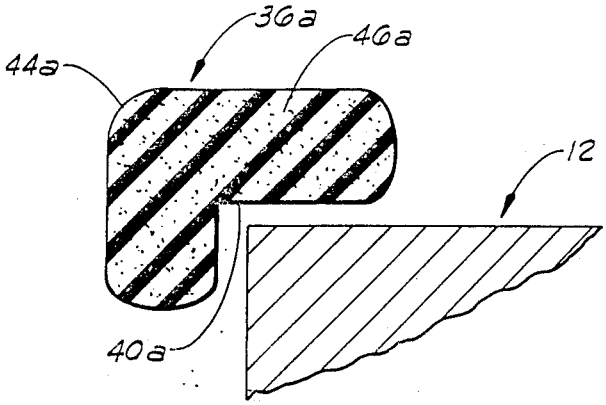
FIG. 11 is a cross-sectional view of the modified outer hearth pad taken substantially along lines 11—11 of FIG. 10.

A modified outer hearth pad **10*a* having a cover assembly 36*a*, including a front cover assembly 47*a*, a first side cover assembly 56*a*, a second side cover assembly 66*a*, an inner surface 40*a* and an outer surface 44*a* is shown in FIGS. 10 and 11. The outer hearth pad 10*a* is fitted to the outer hearth exactly like the outer hearth pad 10, and the outer hearth pad 10*a* is constructed similar to the outer hearth pad 10, except the outer hearth pad 10*a* is devoid of a frame assembly and the cover assembly 36*a* is made of a molded padding material 46*a* sized for conformingly overlying the outer hearth 12. The outer surface 44*a* of the cover assembly 36*a*** is preferably coated with or covered by a flame retardant material.

The present invention further comprises a method for constructing an outer earth pad. In accordance with the method for constructing the outer hearth pad, the front assembly 78 is sized for receiving the first side assembly 88 and the second side assembly 100 such that when the hearth pad 10 is installed, a portion of the first side assembly 88 and the second side assembly 100 snugly embrace and interferingly fit over portions of the respective end side surfaces of the outer hearth 12.

It is understood that the thickness of the cover assembly 36 adjacent the inner surface 40 of the frame assembly 38 and thickness of the side assemblies 88 and 100 are taken into account when determining the overall dimension of the front assembly 78 in order to achieve a snug, embracing interfering fit between the outer hearth pad 10 and the outer hearth 12.

It is further understood that when installing the outer hearth pad **10*a* on the outer hearth 12, the front cover assembly 47*a* is sized for receiving the first side cover assembly 56*a* and the second side cover assembly 66*a*** such that a portion of the inner surface 40*a* of the first side cover assembly 56*a* and the second side cover assembly 66*a* snugly embrace and interferingly fit over portions of the respective end side surfaces of the outer hearth 12.

The outer hearth pad 10*a* may be secured to the outer hearth by way of Velcro TM strips on the outer hearth and on the outer hearth pad 10*a*.

Further, in those instances in which the outer hearth surface includes numerous protrusive portions, as is generally the condition when the outer hearth 12 is constructed of stone or rock, the outer hearth pad 10 is constructed exactly as described above, except that the inner surfaces 40 of the frame assembly 38 may be shaped for receiving the protrusive portions of the outer hearth 12 covered by the outer hearth pad 10. In this way, the outer hearth pad 10 conformingly overlies the outer hearth 12 and is maintained in substantially a horizontal position with respect to the outer hearth 12.

The outer hearth pad 10 may also be secured to the outer hearth 12 by Velcro TM fasteners cooperatively mounted to the outer hearth 12 and the outer hearth pad 10, respectively. Additionally, a plurality of dowels may be mounted to the outer hearth 12, and a plurality of hooks, for engaging the dowels, mounted to the inner surface of the outer hearth pad 10, such that when the outer hearth pad 10 overlies the outer hearth 12, the hooks retentively engage the dowels thereby securing the outer hearth pad 10 to the outer hearth 12. The covering material preferably is a flame retardant material.

In a preferred form, all outside edges of the frame assembly 38 are rounded. It is not necessary to round the inside edges. Also, the outer hearth pad can be connected to the outer hearth 12 by drilling a hole in the outer hearth 12 and a dowel pin inserted in this hole and extending a distance above the outer hearth 12, the dowel pin extending into a hole formed in the frame assembly 38 and being secured therein.

Changes may be made in the construction and operation of the various elements, parts and assemblies described herein and in the steps or sequence of steps of the methods described herein without departing from the spirit and scope of the invention as defined in the following claims.

I claim:

1. An outer hearth pad for covering a portion of an outer hearth having an elevated edge comprising:

a frame assembly comprising a plurality of interconnected structural members and having an inner surface and an outer surface, the inner surface being sized for overlaying the elevated edge of the outer hearth; and a cover assembly connected to the frame assembly and extending over a substantial portion of the outer surface of the frame assembly, the frame assembly with the cover assembly connected thereto being disposable over the elevated edge of the outer hearth and the cover assembly protectively covering a portion of the elevated edge over which it extends when the frame assembly with the cover assembly connected thereto is disposed over the elevated edge, the frame assembly supporting a substantial portion of the cover assembly a distance above the elevated edge.

2. The outer hearth pad of claim 1 wherein the outer hearth is defined further to include a side surface extending a distance generally in an upwardly direction and a top surface extending generally in a horizontal plane and intersecting the side surface with the elevated edge being formed by the intersection between the side surface and the top surface, and wherein the frame assembly is defined further to include one portion extendable generally over a portion of the side surface of the outer hearth and another portion extendable generally over a portion of the top surface of the hearth.

3. The outer hearth pad of claim 2 wherein the side surface is defined further to include a front side surface extending a distance in a generally upwardly direction and intersecting the top surface, and wherein the elevated edge is defined further to comprise a front elevated edge formed by the intersection between the top surface and the front side surface, and wherein the hearth is defined further to include a first end side surface extending a distance in a generally upwardly direction intersecting a portion of the top surface, the first end side surface being disposed generally near one end of the front side surface, and wherein the elevated edge is defined further to comprise a first end elevated edge formed by the intersection between the first end side surface and the top surface, and wherein the frame assembly is defined further to include one portion extendable a distance generally over a portion of the first end side surface generally near the first end elevated edge and another portion extendable a distance generally over the top surface generally near the first end elevated edge.

4. The outer hearth pad of claim 1 wherein the outer hearth is defined further to include a front side surface extending a distance generally in an upwardly direction and a top surface extending generally in a horizontal plane intersecting the front side surface, and wherein the elevated edge comprises a front elevated edge formed by the intersection between the top surface and the front side surface, and wherein the frame assembly is defined further to include one portion extendable generally over a portion of the top surface generally near the front elevated edge and another portion extendable generally over a portion of the front side surface generally near the front elevated edge.

5. The outer hearth pad of claim 4 wherein the front side surface is defined further as having a first end side surface extending a distance generally in an upwardly direction and intersecting a portion of the top surface with the first end side surface being disposed generally adjacent and extending at an angle from one end of the front side surface, and wherein the elevated edge comprises a first end elevated edge formed by the intersection between the first end side surface and the top surface, and wherein the frame assembly is defined further to include one portion extendable a distance generally over a portion of the first end side surface generally near the first end elevated edge and another portion extendable a distance generally over the top surface generally near the first end elevated edge.

6. The outer hearth pad of claim 5 wherein the hearth is defined further to include a second end side surface extending a distance generally in an upwardly direction and intersecting a portion of the top surface, the second end side surface being disposed generally adjacent and extending at an angle from one end of the front side surface, opposite the end of the front side surface disposed near the first end side surface, and wherein the elevated edge is defined further to comprise a second end elevated edge formed by the intersection between the top surface and the second end side surface, and wherein the frame assembly is defined further to include one portion extendable a distance generally over the top surface generally near the second end elevated edge and another portion disposable generally over a portion of the second end side surface generally near the second end elevated edge.

7. The outer hearth pad of claim 1 wherein the cover assembly is defined further to comprise:

a padding material constructed of a resilient material extending generally over a substantial portion of the outer surface of the frame; and a covering material extending generally over the padding material, the covering material being secured to the frame and cooperating to secure the pad to the frame.

8. The outer hearth pad of claim 1 wherein the frame assembly with the cover assembly connected thereto is defined further as being sized to interferingly fit over the elevated edge so the interfering fit cooperates to secure the frame assembly with the cover assembly connected thereto to the outer hearth.

9. A method for constructing an outer hearth pad for covering a portion of an outer hearth having an elevated edge formed by the intersection between a top surface extending generally in a horizontal plane, and a side surface, extending a distance generally in an upwardly direction and intersecting the top surface to form the elevated edge, wherein the outer hearth pad includes a frame assembly and a cover assembly overlying the outer surface of the frame and secured to the frame assembly comprising the step of:

sizing the frame assembly with the cover assembly connected thereto so a portion of the outer hearth pad extends over a portion of the side surface generally adjacent the elevated edge and so another portion of the outer hearth pad extends over a portion of the top surface generally adjacent the elevated edge and so the outer hearth pad interferingly fits over the elevated edge for cooperating to retain the outer hearth pad connected to the outer hearth.

10. The method of claim 9 wherein the elevated edge of the outer hearth is further defined as having a front elevated edge formed by the intersection between the top surface and a front side surface extending a distance generally in an upwardly direction, a first end elevated edge formed by the intersection between the top surface and a first end side surface extending a distance generally in an upwardly direction, and a second end elevated edge formed by the intersection between the top surface and a second end side surface extending a distance generally in an upwardly direction, and wherein the frame assembly is further defined as having a front assembly, a first side assembly connected to one end of the front assembly, and a second side assembly connected to the opposite end of the front assembly, each having portions defining the inner surface and the outer surface of the frame assembly, and wherein the cover assembly overlies the outer surfaces of the front assembly, the first side assembly and the second side assembly, the method further comprising:

sizing the front assembly of the first side assembly and the second side assembly so that a portion of the first side assembly and a portion of the second side assembly interferingly fit over a portion of the first end side surface and a portion of the second end side surface respectively, wherein the front assembly with the cover assembly connected thereto is further defined by a portion of the front assembly with the cover assembly connected thereto extending over a portion of the top surface generally near the front elevated edge, and another portion of the front assembly with the cover assembly connected thereto extending over a portion of the first side surface generally adjacent the front elevated edge, and wherein the first side assembly with the cover assembly connected thereto is further defined by a portion of the first side assembly with the cover assembly connected thereto extending over a portion of the top surface generally adjacent the front elevated edge and another portion of the first side assembly with the cover assembly connected thereto extending over a portion of the first end side surface generally adjacent the first end elevated edge, and wherein the second side assembly with the cover assembly connected thereto is further defined by a portion of the second side assembly with the cover assembly connected thereto extending over a portion of the top surface generally adjacent the second end elevated edge and another portion of the second side assembly with the cover assembly connected thereto extending over a portion of the second end side surface generally adjacent the second end elevated edge 11. The method of claim 10 wherein the outer hearth is further defined as having protrusive portions, further comprising:

shaping the inner surface of the frame assembly for conformingly overlying the protrusive portions adjacent the inner surface.

12. A method for constructing an outer hearth pad for covering a portion of an outer hearth having an elevated edge formed by the intersection between a top surface extending generally in a horizontal plane, and a side surface, extending a distance generally in an upwardly direction and intersecting the top surface to form the elevated edge, wherein the outer hearth pad includes a cover assembly comprising the step of:

sizing the cover assembly so a portion of the outer hearth pad extends over a portion of the side surface generally adjacent the elevated edge and so another portion of the outer hearth pad extends over a portion of the top surface generally adjacent the elevated edge and so the outer hearth pad interferingly fits over the elevated edge for cooperating to retain the outer hearth pad connected to the outer hearth.

13. The method of claim 12 wherein the elevated edge of the outer hearth is further defined as having a front elevated edge formed by the intersection between the top surface and a front side surface extending a distance generally in an upwardly direction, a first end elevated edge formed by the intersection between the top surface and a first end side surface extending a distance generally in an upwardly direction, and a second end elevated edge formed by the intersection between the top surface and a second end side surface extending a distance generally in an upwardly direction, and wherein the cover assembly is further defined as having a front cover assembly, a first side cover assembly connected to one end of the front cover assembly, and a second side cover assembly connected to the opposite end of the front cover assembly, each having portions defining an inner surface and the outer surface of the cover assembly, the method further comprising:

sizing the first side cover assembly and the second side cover assembly so that a portion of the first side cover assembly and a portion of the second side cover assembly interferingly fit over a portion of the first end side surface and a portion of the second end side surface respectively, wherein the cover assembly is further defined by a portion of the front cover assembly extending over a portion of the top surface generally near the front elevated edge, and another portion of the front cover assembly extending over a portion of the first side surface generally adjacent the front elevated edge, and wherein the first side cover assembly is further defined by a portion of the first side cover assembly extending over a portion of the top surface generally adjacent the front elevated edge and another portion of the first side cover assembly extending over a portion of the first end side surface generally adjacent the first end elevated edge, and wherein the second side cover assembly is further defined by a portion of the second side cover assembly extending over a portion of the top surface generally adjacent the second end elevated edge and another portion of the second side cover assembly extending over a portion of the second end side surface generally adjacent the second end elevated edge.

14. The method of claim 13 wherein the outer hearth is further defined as having protrusive portions, further comprising:

shaping the inner surface of the cover assembly for conformingly overlying the protrusive portions adjacent the inner surface.

* * * * *